US005140884A

United States Patent [19]

Bowden

[11] Patent Number: 5,140,884

[45] Date of Patent: Aug. 25, 1992

[54] DETACHABLE STRING BENDER

[75] Inventor: Richard M. Bowden, Nashville, Tenn.

[73] Assignee: Gibson Guitar Corp., Nashville, Tenn.

[21] Appl. No.: 613,130

[22] Filed: Nov. 14, 1990

[51] Int. Cl.[5] ..... G10D 3/14

[52] U.S. Cl. ..... 84/312 R; 84/297 R; 84/298

[58] Field of Search ..... 84/312 R, 297 R, 312 P, 84/313, 298, 299

[56] References Cited

U.S. PATENT DOCUMENTS

| | | | |
|---|---|---|---|
| 2,741,146 | 4/1956 | Fender | 84/313 |
| 3,479,917 | 11/1969 | Zitnik, Jr. et al. | 84/312 R |
| 4,171,661 | 10/1979 | Rose | 84/313 |
| 4,457,201 | 7/1984 | Storey | 84/313 |
| 4,487,100 | 12/1984 | Storey | 84/299 |
| 4,497,236 | 2/1985 | Rose | 84/313 X |
| 4,535,670 | 8/1985 | Borisoff | 84/312 R |
| 4,549,461 | 10/1985 | Rose | 84/313 |
| 4,555,970 | 12/1985 | Rose | 84/313 |
| 4,625,613 | 12/1986 | Steinberger | 84/298 |
| 4,632,004 | 12/1986 | Steinberger | 84/313 |
| 4,632,005 | 12/1986 | Steinberger | 84/313 |
| 4,643,069 | 2/1987 | Borisoff et al. | 84/306 |
| 4,667,561 | 5/1987 | Storey et al. | 84/314 N |
| 4,690,028 | 9/1987 | Steinberger | 84/313 X |
| 4,704,936 | 11/1987 | Steinberger | 84/313 |
| 4,742,750 | 5/1988 | Storey | 84/313 |
| 4,860,628 | 8/1989 | Storey | 84/313 |
| 4,878,413 | 11/1989 | Steinberger | 84/314 N |
| 4,882,967 | 11/1989 | Rose | 84/313 |
| 4,892,025 | 1/1989 | Steinberger | 84/313 |
| 4,907,483 | 3/1990 | Rose et al. | 84/726 |
| 4,915,006 | 4/1990 | Steinberger | 84/314 N |

OTHER PUBLICATIONS

The Guitar Handbook by Denyer, published by Alfred A. Knopf, 1982, p. 181.

*Primary Examiner*—W. B. Perkey
*Assistant Examiner*—Cassandra C. Spyrou
*Attorney, Agent, or Firm*—Laney, Dougherty, Hessin & Beavers

[57] ABSTRACT

A string bender apparatus is provided for a guitar. The guitar has a guitar body with a plurality of guitar strings mounted thereon, and also includes a protruding structure such as a bridge or tail piece defined on the guitar body and operably associated with the guitar strings. The string bender apparatus includes a frame having an actuating lever pivotally attached thereto. The actuating lever is attached to one of the guitar strings for varying the tension on the string by pivoting the actuating lever relative to the frame. An adapter is provided for removably attaching the frame of the string bender apparatus to the protruding structure of the guitar.

26 Claims, 3 Drawing Sheets

DETACHABLE STRING BENDER

BACKGROUND OF THE INVENTION

1. Field of the Invention

The present invention is directed generally to apparatus for varying the tension on a guitar string to vary the pitch thereof as the guitar is played, and more particularly, but not by way of limitation, to such apparatus which can be readily attached and detached from a guitar without damaging the guitar.

2. Description of the Prior Art

There are two general types of devices utilized with stringed instruments such as guitars for varying the tension on the strings as they are played. One such device generally known as a tremolo includes a spring-loaded arm which when depressed lowers the pitch of all six strings of the guitar. Another such device known as a string bender functions to either raise or lower the pitch on less than all of the strings, and typically on only one selected string.

On drawback with such devices is that they typically must be mounted as a permanent part of the guitar. For example, one well known string bender construction is that known as the Parsons-White string bender which is described at page 181 of *The Guitar Handbook*, by Denyer, and published by Alfred A. Knopf, 1982. The Parsons-White string bender includes a system of levers and springs mounted within a cavity which must be carved out of the guitar body. The levers are attached to the guitar strap. When the player pulls down on the guitar itself, the strap tightens the linkage which acts upon the guitar strings. This is a very permanent part of the guitar since it removes about twenty-five percent of the wood in the guitar body.

Another string bender device, commonly referred to as the Bigsby Palm Pedal, and generally described in U.S. Pat. No. 3,479,917 to Zitnik, Jr., et al., includes a horseshoe-shaped frame which screws down to the top of the guitar and supports one or more pivoted arms. Each arm can control an individual guitar string.

One prior art string bender device which is constructed to be mounted on the guitar without damaging the guitar is that commonly known as the Borisoff "Hip Shot" and disclosed in U.S. Pat. No. 4,535,670 to Borisoff. This device is held onto the guitar by the strap button screw at the butt of the instrument. The player moves his hip against a lever, which through a linkage, pulls the selected guitar string. A second lever is provided which can be manually engaged to change the pitch on a second selected guitar string.

There is a need for a simple, inexpensive yet effective string bender device which can be mounted on the guitar without permanently defacing or damaging the guitar. Just such a structure is provided by my present invention which is described below.

SUMMARY OF THE INVENTION

A string bender apparatus is provided for a guitar. A conventional guitar has a guitar body with a plurality of guitar strings mounted thereon. One or more protruding structures are defined on the guitar body and are operably associated with the guitar strings. These protruding structures typically include a combination bridge and tail piece, or separate bridge and tail piece structures.

The string bender apparatus of the present invention includes a frame and an adapter means operably associated with the frame for removably clamping the frame to the protruding structure of the guitar without any part of the adapter means extending into the guitar body. An actuating lever is pivotally attached to the frame. The actuating lever includes string engagement means for connecting one of the guitar strings thereto and for varying tension on the guitar string by pivoting the actuating lever relative to the frame.

An adjustable stop means is operably associated with the frame and the actuating lever for limiting a string tension varying pivotal motion of the actuating lever relative to the frame. The stop means includes a threaded stop pin extending through a threaded hole in the actuating lever toward the frame, and an elongated locking bar means threadedly engaged with the stop pin for locking the stop pin in position relative to the actuating lever. This permits the position of the stop pin to be varied by manually loosening the locking bar, rotating the stop pin within the threaded hole, and then manually retightening the locking bar to relock the stop pin in its new position.

The frame includes a first portion and a second portion. A connecting means is provided between the first and second portions of the frame for permitting sliding motion of the second portion relative to the first portion in a direction generally parallel to a length of the guitar after string tension is released from the guitar string. The connecting means also permits pivotal motion of this second portion of the frame relative to the first portion after the first and second portions are slidably separated so that the actuating lever can be laid down adjacent the guitar body for storage of the guitar.

When the string bender is in its normal operating position the second portion of the frame and the actuating lever are held in place by tension in the guitar string attached to the actuating lever.

Numerous objects, features and advantages of the present invention will be readily apparent to those skilled in the art after a reading of the following disclosure when taken in conjunction with the accompanying drawings.

DETAILED DESCRIPTION OF THE PREFERRED EMBODIMENT

Figure 1:
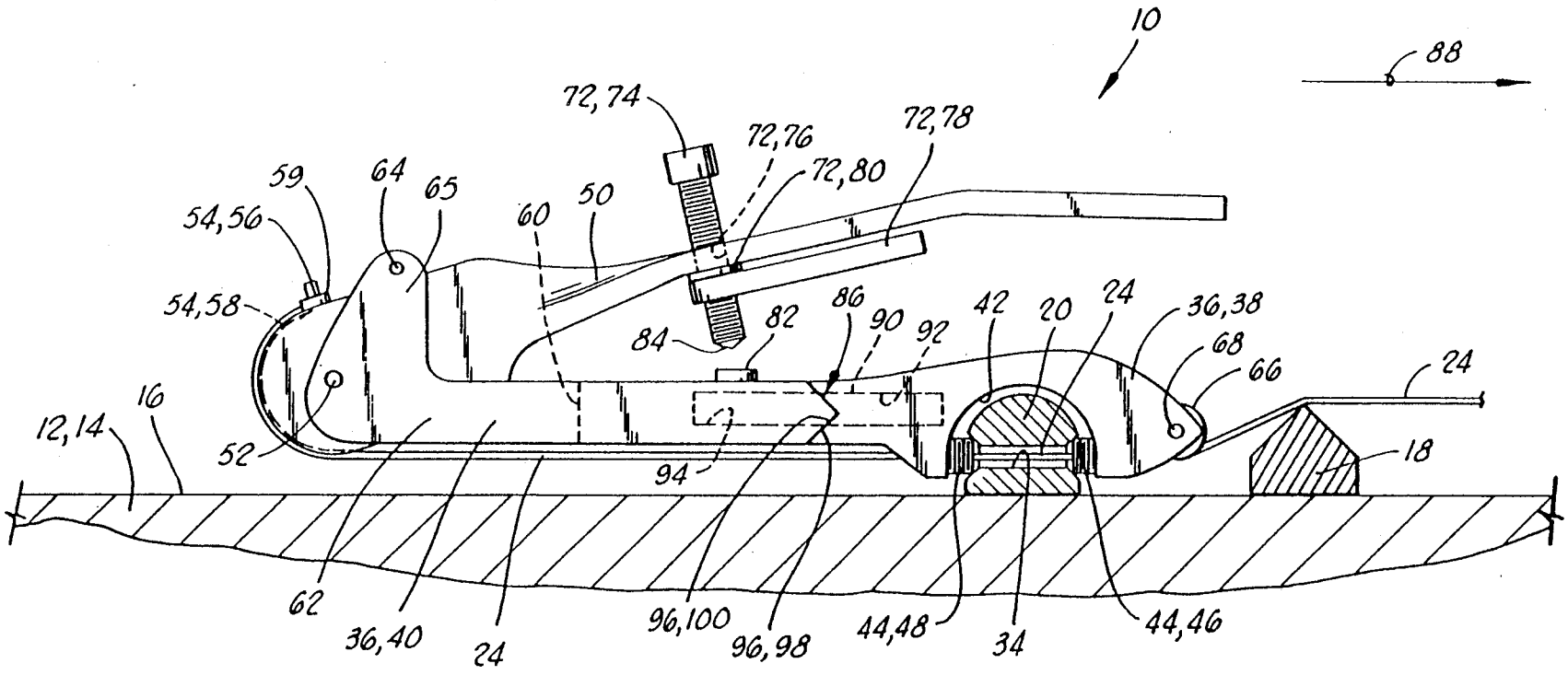
FIG. 1 is a side elevation view of the string bender apparatus mounted on a guitar. The guitar is shown schematically in section, and only a segment of the face of the guitar body having a bridge and tail piece protruding therefrom is shown. The string bender apparatus is shown in its operating position wherein depression of the actuating lever will raise the tension on the guitar string attached thereto.
Figure 2:
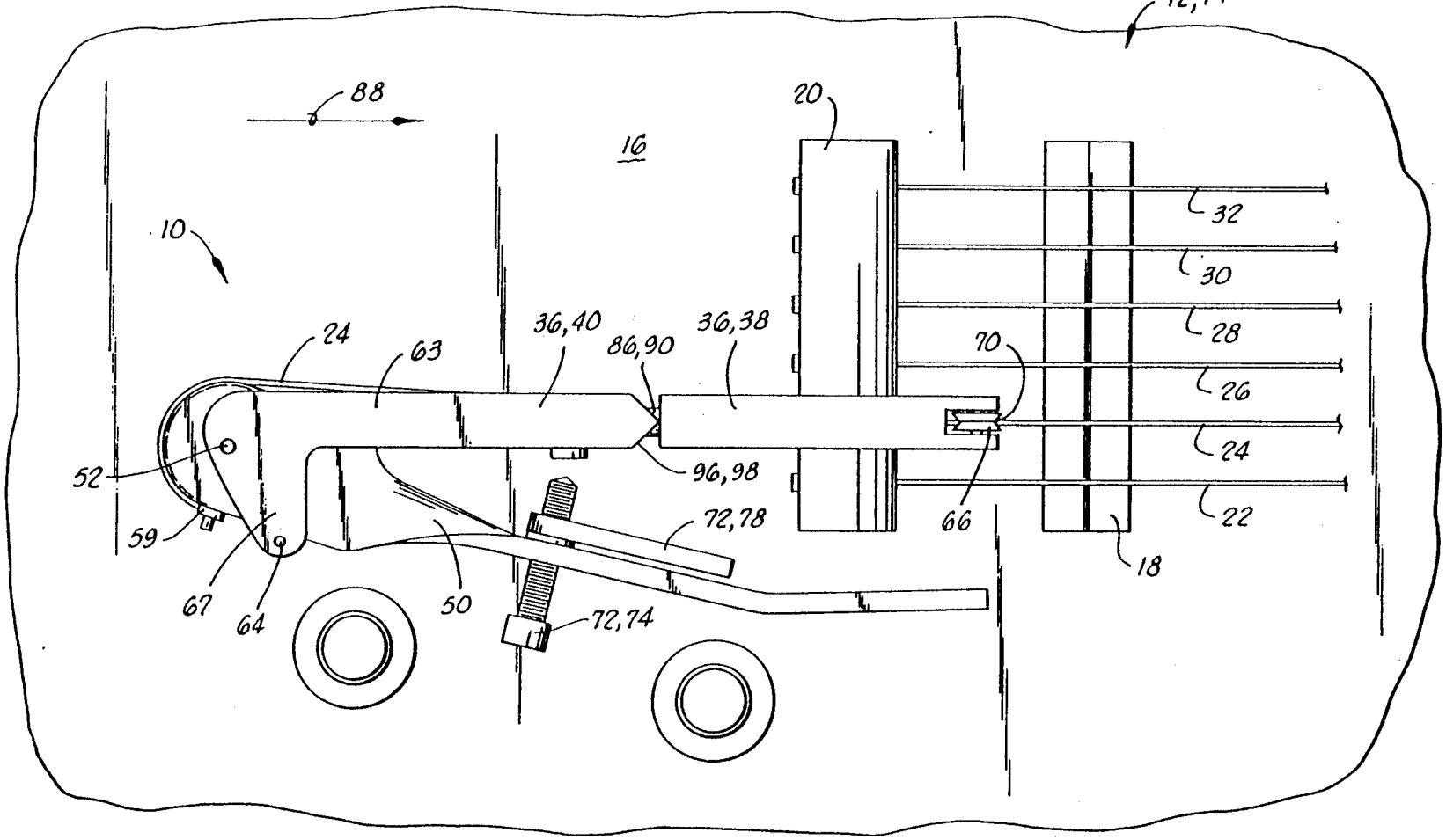
FIG. 2 is a plan view of the front surface of the guitar body showing the string bender apparatus in its breakdown position where it is ready for storage in a guitar case.

The string bender apparatus of the present invention is shown in FIGS. 1 and 2 and is generally designated by the numeral 10. The apparatus 10 is constructed to be mounted on a guitar 12. The guitar 12 is schematically illustrated and has a body shown partially in cross section and designated by the numeral 14. The forward face of the body i shown and designated by the numeral 16. Schematically illustrated are a bridge 18 and a stop bar type tail piece 20 which can generally be described as protruding structures 18 and 20 protruding from the guitar body 14. The guitar 12 schematically illustrated in FIGS. 1 and 2 corresponds generally to one well known guitar manufactured by Gibson Guitar Corp. of Nashville, Tenn., and known as the Les Paul® series guitar.

As best seen in FIG. 2, the guitar 12 has six strings mounted thereon which are designated as 22, 24, 26, 28, 30 and 32. The strings 22–32 are normally mounted on the guitar body 12 by laying the same over the top surface of bridge 18 as seen in FIG. 1, and locking an enlarged end of the guitar string in a passage 34 defined through the tail piece 20 in a conventional well known manner.

The string bender apparatus 10 is preferably connected to the second string 24, although it can of course be utilized with any of the strings of the guitar.

The string bender apparatus 10 includes an frame 36 including a first or forward frame portion 38 and a second or rearward frame portion 40. As best seen in FIG. 2, the frame 36 is narrow enough that six string benders could be mounted side by side with one string bender attached to each of the strings.

The first and second portions 38 and 40 of frame 36 can also be referred to generally as forward and rearward portions 38 and 40, respectively. In the context of this description, the term "forward" refers to directions as indicated by the arrow 88 in FIGS. 1 and 2 pointing toward the head of the guitar, and the term "rearward" refers to directions opposite that of the arrow 88.

The string bender apparatus 10 includes an adapter means 41 for removably attaching the frame 36 to the tail piece 20 without any part of the adapter means, including screws or bolts or the like, extending into or through the guitar body. No holes need be made in the guitar body for screws, bolts or the like, and thus there is no damage to the guitar body. The adapter means 41 includes a recess means 42 defined in the first frame portion 38 for receiving the tail piece 20 therein as best seen in FIG. 1. Adapter means 41 further includes a clamping means 44 operably associated with the frame 36 for removably clamping the first frame portion 38 to the tail piece 20.

The clamping means 44 can also generally be described as an attachment means 44 for attaching the first or forward frame portion 38 of frame 36 to the guitar 12.

Clamping means 44 includes first and second diametrically opposed set screws 46 and 48 each threadedly engaged with the first frame portion 38 and protruding into the recess 42 for engaging the tail piece 20. Each of the set screws 46 and 48 are hollow set screws having axial bores defined therethrough which are aligned with the passageway 34 through which the second string 24 passes through tail piece 20. The guitar string 24 freely extends through the axial bores of set screws 46 and 48 and through the passageway 34.

The string bender 10 also includes an actuating lever 50 pivotally attached to the second frame portion 40 at pivot pin 52.

The actuating lever 50 includes string engagement means generally designated by the numeral 54 for connecting the guitar string 24 to the lever 50 and for varying tension on the guitar string 24 by pivoting the lever 50 clockwise as seen in FIG. 1 relative to the frame 36.

The connecting means 54 includes an anchor pin 56 by which the end of guitar string 24 is fixedly attached to a grooved rounded end 58 on the rear portion of lever 50. A ring type end piece 59 attached to string 24 slips over the anchor pin 56. The guitar string 24 is closely received about the grooved rounded end 58. The grooved rounded end 58 is utilized to eliminate any sharp bends in the string path thus minimizing the possibility of string breakage. This is contrasted to prior art devices such as the Bigsby Palm Pedal which is known to experience string breakage at a sharp bend through the hole where the string attaches and threads under its lever.

The rear end of second or rearward portion 40 of frame bracket 36 is bifurcated to define a cavity between two identical rearward arms 62 and 63. The dashed line designated by the numeral 60 indicates the forward extent of the cavity between the two arms 62 and 63. The actuating lever 50 is mounted within the cavity between arms 62 and 63 on the pivot pin 52 previously mentioned. The arms 62 and 63 have upward extending plate portions 65 and 67, respectively. A limit pin 64 spans between the plate portions 65 and 67 and is in position to abut the lever 50 to limit counterclockwise motion of lever 50 as seen in FIG. 1.

To mount the apparatus 10 on the guitar 12, the guitar string 24 is removed from the guitar 12, and its rearward end is attached to anchor pin 56 as seen in FIG. 1. Then the free forward end of the guitar string is threaded through hollow set screw 48, passage 34 of tail piece 20, and hollow set screw 46. A grooved guide roller 66 mounted on roller pin 68 in the forward frame portion 38 allows the guitar string 24 to smoothly pass thereunder and then across the top of the bridge 18. The forward end (not shown) of guitar string 24 is then attached to the head of the guitar and tightened with a conventional tuning head. The guitar string 24 is tuned with the tuning head so that when the apparatus 10 is in the position shown in FIG. 1, the guitar string 24 has its normal desired tension and accompanying musical pitch. The pitch of the guitar string 24 can be temporarily raised by depressing the lever 10 to pivot it clockwise as seen in FIG. 1.

As best seen in FIG. 2, the guide roller 66 has a peripheral groove 70 defined therein. The lower extent of the groove 70 is generally aligned with the axial bore of the hollow set screw 46 so that the guitar string 24 is smoothly guided by guide roller 66 into alignment with the hollow set screws 46 and 48 and the passageway 34 through tail piece 20.

The guide roller 66, axial bores of set screws 46 and 48, and the grooved rounded end 58 of lever 50 can be collectively referred to as a guide means for freely slidably guiding the guitar string 24 along a length of the string bender apparatus 10 to its point of physical attachment to the lever 50 at anchor pin 56. The axial bores of hollow set screws 46 and 48 can generally be referred to as string receiving opening means defined through the set screws 46 and 48 of frame 36 for allowing free movement of the guitar string 24 between the guide roller 66 and the connecting means or string engagement means of the actuating lever 50.

The use of the roller guide to guide the guitar string through the string receiving passageway in the tail piece allows an unobstructed, relatively friction free travel of the guitar string as it is repeatedly tightened by depression of the actuating lever. This allows the string to return to its true pitch after the lever 50 is released thus eliminating tuning problems which would otherwise occur.

The utilization and positioning of the roller guide is very important to the optimum operation of the string bender apparatus. The positioning of the guide roller 66 is such that the string 24 touches nothing between the bridge saddle 18 and the grooved rounded end 58 of the actuating lever 50, other than the guide roller 66 itself. This is necessary to eliminate tuning problems with the string bender. Also, the guide roller 66 and the pivot pin 52 of the actuating lever 50 are the only two friction points embodied in the string bender, thus tuning problems are virtually nil. This is not true with various prior art devices such as the Bigsby Palm Pedal or the Parsons-White string bender discussed above which both embody multiple friction points, i.e., linkage pivots and large pivot surfaces in the levers.

The string bender apparatus 10 further includes an adjustable stop means 72 operably associated with frame 36 and actuating lever 50 for limiting a string tension varying pivoting motion of actuating lever 50 about pivot pin 52 relative to frame 36. The stop means 72 includes a threaded stop pin 74 extending through a threaded hole 76 in actuating lever 50 toward the frame 36. Adjustable stop means 72 further includes an elongated locking bar means 78 threadedly engaged with stop pin 74 for locking the stop pin 74 in position relative to the actuating lever 50. A plastic spacer 80 is located about stop pin 74 between actuating lever 50 and locking bar means 78.

The locking bar means 78 allows the position of the stop pin 74 to be varied by manually loosening the threaded engagement of locking bar means 78 with stop pin 74, then rotating the stop pin 74 within the threaded hole 76 to advance or retract the stop pin 74, and then manually retightening the locking bar means 78 to relock the stop pin 74 in its new position.

A small pad 82 is attached to the top of rear frame portion 40 with adhesive, to provide a padded impact point for a lower end B4 of the stop pin 74. Thus, when the actuating lever 50 is pushed downward to raise the pitch on guitar string 24, the downward movement as seen in FIG. 1 is limited by engagement of the lower end 84 of stop pin 74 with the pad 82. By adjusting the position of stop pin 74, the change in pitch of guitar string 24 upon depression of lever 50 is adjusted.

The string bender apparatus 10 is shown in FIG. 1 in its normal operating position wherein the actuating lever 50 extends generally upward above the front surface 16 of guitar 12. It will be appreciated, however, that this position of the actuating lever 50 would interfere with the placement of the guitar 12 in a conventional closely fitting guitar case in which the guitar is stored.

To accommodate placement of the guitar 12 in a conventional guitar case, a means has been provided for breaking down the string bender apparatus 10 to a storage position as seen in FIG. 2. This is accomplished through a connecting means 86 defined between the first and second frame portions 38 and 40 for permitting sliding motion of the second frame portion 40 relative to the first frame portion 38 in a direction generally parallel to a length of the guitar 12, which can also be described as being generally parallel to the guitar strings 22–32.

The connecting means 86 also is a means for permitting pivotal motion of the second frame portion 40 relative to the first frame portion 38 about a pivotal axis which is also generally parallel to the guitar strings. This pivotal motion is permitted after the first and second frame portions 38 and 46 are slidably separated as seen in FIG. 2 so that the actuating lever 50 can be laid down adjacent the front surface 16 of guitar body 12 for storage of the guitar.

The connecting means 86 can also generally be referred to as a breakdown means 86, interconnecting the first and second portions 38 and 40 of frame 36, for allowing the second portion 40 to be moved relative to the first portion 36 between the operating position of FIG. 1 and the breakdown position of FIG. 2.

The connecting means 86 includes a cylindrical pin 90 which is shown in dotted lines in FIG. 1, and which is partly visible in solid lines in FIG. 2. The cylindrical pin 90 has a forward portion which is fixedly received in a bore 92 within the first or forward portion 38 of frame 36. The cylindrical pin 90 includes a rearward portion which is freely slidably received within a bore 94 defined in the second or rearward portion 40 of frame 36. When the tension in guitar string 24 is released by loosening the same at the machine head located at the headstock (not shown) of the guitar, the rearward portion 40 of frame 36 can slide rearward along pin 90 to the position shown in FIG. 2, and then the rear portion of frame 36 can pivot about the axis of cylindrical pin 90 to the position shown in FIG. 2 where the actuating lever 50 is laid over to a position adjacent the surface 16 of the guitar 12.

The connecting means 86 also includes an interlocking alignment means 96 for locking the rearward frame portion 40 in its operating position closely adjacent the forward frame portion 38 as seen in FIG. 1 when the guitar string 24 is under its normal operating tension. This interlocking alignment means 96 includes a V-shaped protrusion 98 on the rearward frame portion 40 and a complementary V-shaped recess 100 on the forward frame portion 38.

THE ALTERNATIVE EMBODIMENT OF FIGS. 3–5

Figure 3:
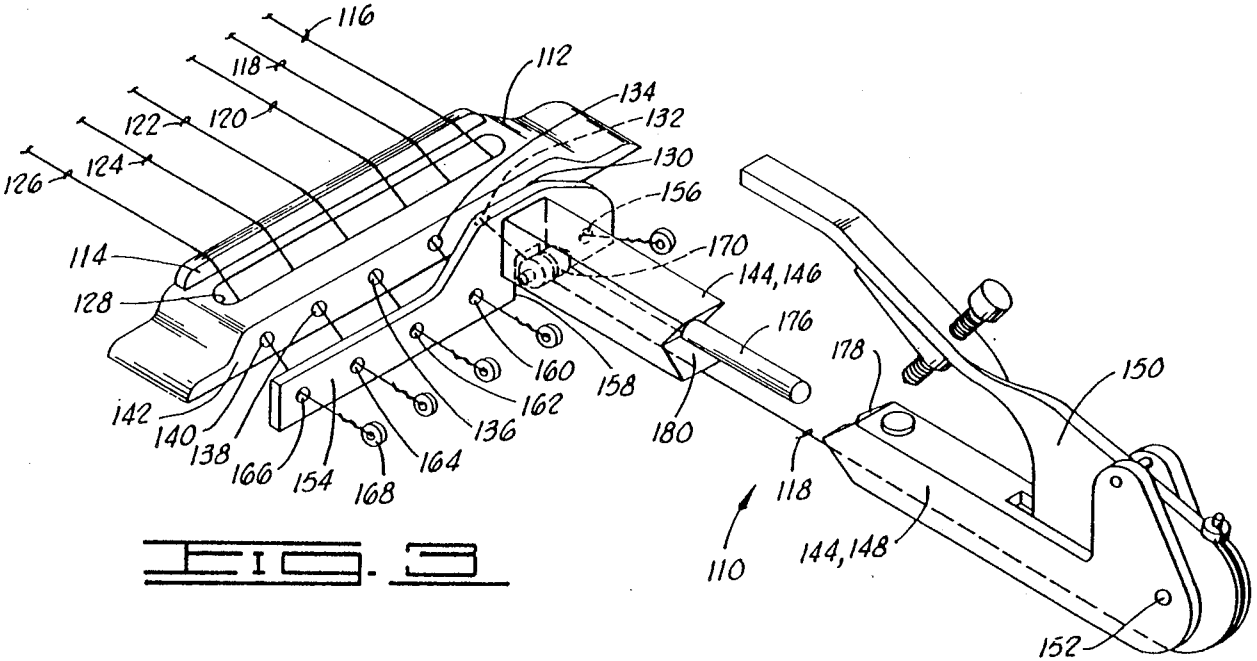
FIG. 3 is an exploded isometric view of an alternative embodiment of the present invention.
Figure 4:
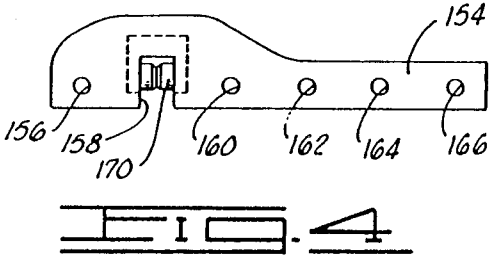
FIG. 4 is a front end view of the mounting plate of the embodiment of FIG. 3.
Figure 5:
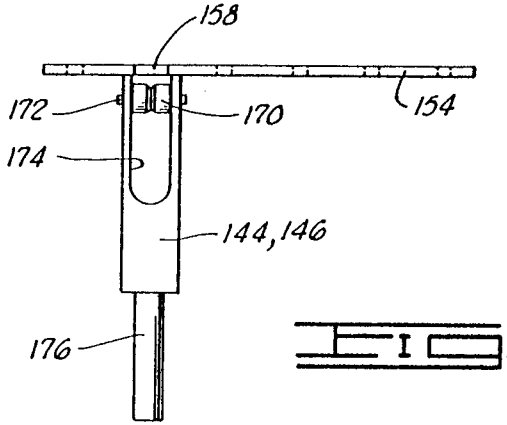
FIG. 5 is a bottom view of the apparatus of FIG. 4.

In FIGS. 3–5, an alternative embodiment of the present invention is shown. The embodiment of FIGS. 3–5 is constructed for use with guitars of the type having a pull-through type bridge structure such as those used on the Chet Atkins® SST model guitar manufactured by Gibson Guitar Corp. Similar pull-through bridges are also used in many Ovation brand guitars.

FIG. 3 is an exploded isometric view which shows the modified string bender apparatus 110 in association with a pull-through type bridge 112.

The bridge 112 includes a saddle 114 over which lies the six guitar strings 116, 118, 120, 122, 124 and 126. The bridge 112 includes an oval-shaped recess 128 which communicates with six string passages 130, 132, 134, 136, 138 and 140.

The bridge 112 includes a planar rear surface 142 which extends generally perpendicular to the front surface 16 (see FIG. 1) of the guitar. The string passages 130–140 intersect the planar rear surface 142.

The string bender apparatus 110 includes a frame 144 having a forward portion 146 and a rearward portion 148. The rearward frame portion 148 has an actuating lever 150 pivotally attached thereto at pivot pin 152. The rearward frame portion 148 with actuating lever 150 is identical in construction to the rearward frame portion 40 and actuating lever 50 of the apparatus of FIGS. 1 and 2 and will not be further described.

The forward frame portion 146 has, however, been modified for mounting on the bridge 112 illustrated in FIG. 3. The forward frame portion 146 includes fixed thereto a mounting plate 154 constructed to abut the planar rearward surface 142 of the bridge 112. The mounting plate 154 has a plurality of string receiving holes 156, 158, 160, 162, 164 and 166 defined therethrough and arranged to be aligned with the plurality of string receiving openings 130–140 defined in the bridge 112. This permits the guitar strings 116–126 to be placed through the string receiving passages 130–140 and the string receiving holes 156–166. The end of each guitar string is twisted about an end piece such as 168 which is too large to pass through the string receiving holes or the string receiving passages. The strings 116–126 are then tensioned by tightening the tuning heads on the peghead of the guitar thus tightly clamping the mounting plate 154 against the planar surface 142 of bridge 112.

Also, as in the embodiment of FIGS. 1–2, the tension in the second string 118 holds the rear frame portion 148 with the attached actuating lever 150 fixedly in place relative to the forward frame portion 146.

In the embodiment of FIGS. 3–5, the entirety of the string bender means 110 is held in place relative to the guitar by tension in the six guitar strings 116–126. There is no other clamping or screw type attachment between the string bender apparatus 110 and the guitar.

Although the bridge 112 seen in FIG. 3 has a planar rear surface 142, it is noted that the string bender apparatus 110 could be used with a pull-through type bridge that has a curved rear surface like that found on many Ovation brand guitars. The plate 154 would be deformed to accommodate the curvature of the rear surface of the bridge.

As seen in FIG. 4, the string receiving hole 158 associated with second string 118 is larger than the other string receiving holes and allows the second string 118 free unrestricted passage to a guide roller 170 which guides the string 118 into a position to extend along the length of string bender apparatus 110 below the frame 146 into engagement with the rounded rear end of actuating lever 150. The guide roller 170 is mounted on a roller pin 172 within a recess 174 machined out of the bottom of the forward frame portion 146 as best seen in FIG. 5.

A cylindrical pin 176 analogous to the previously described cylindrical pin 90 is fixedly attached to the forward frame portion 146 and is freely slidably received within a cylindrical bore of the rearward frame portion 148. A V-shaped protrusion 178 is defined on the rearward frame portion 148 and mates with a V-shaped recess 180 in the forward frame portion 146 in the same manner previously described for the connecting means 86 of the apparatus of FIGS. 1–2.

Thus it is seen that the apparatus of the present invention readily achieves the ends and advantages mentioned as well as those inherent therein. While certain preferred embodiments of the present invention have been illustrated and described for the purposes of the present disclosure, numerous changes in the arrangement and construction of parts may be made by those skilled in the art which changes are encompassed within the scope and spirit of the present invention as defined by the appended claims.

What is claimed is:

1. A string bender apparatus for a guitar having a plurality of guitar strings and having a guitar body with a protruding structure defined on said guitar body and operably associated with said guitar strings, said string bender apparatus comprising:

a frame;

an actuating lever pivotally attached to said frame, said actuating lever including string engagement means for connecting one of said guitar strings thereto and for varying tension on said string by pivoting said actuating lever relative to said frame; and adapter means for removably attaching said frame to said protruding structure of said guitar without any part of said adapter means extending into said guitar body.

2. The apparatus of claim 1, wherein said adapter means comprises:

said frame having a recess means defined therein for receiving said protruding structure of said guitar therein; and clamping means, operably associated with said frame, for removably clamping said frame to said protruding structure of said guitar.

3. The apparatus of claim 2, wherein:

said clamping means includes at least one set screw threadedly engaged with said frame and protruding into said recess means to engage said protruding structure of said guitar.

4. The apparatus of claim 3, wherein:

said set screw has an axial bore extending therethrough; and said set screw is located on said frame so that said guitar string can freely extend through said axial bore of said set screw when said guitar string is attached to said string engagement means of said actuating lever.

5. The apparatus of claim 4, further comprising:

a guide roller, rotatably mounted on said frame, and having a peripheral groove defined therein, said groove being aligned with said axial bore of said set screw so that said guitar string can be received in said peripheral groove of said guide roller.

6. The apparatus of claim 4, wherein:

said clamping means further includes a second set screw also having an axial bore extending therethrough, said second set screw being located on an opposite side of said recess means from said first mentioned set screw, and said axial bores of said first and second set screws being aligned with each other.

7. The apparatus of claim 6, said protruding structure of said guitar body having a passage defined therethrough for receiving said one guitar string, wherein:

said first and second set screws are arranged so that said axial bores thereof may be aligned with said passage of said protruding structure.

8. The apparatus of claim 1, further comprising:

guide means for freely guiding said guitar string along a length of said string bender apparatus to said string engagement means.

9. The apparatus of claim 8, wherein said guide means comprises:

a guide roller, rotatably mounted on said frame and having a peripheral groove defined therein so that said guitar string can be received in said peripheral groove of said guide roller when said guitar string is attached to said string engagement means and is under normal operating tension; and said frame having string receiving opening means defined therethrough for allowing free movement of said guitar string between said guide roller and said string engagement means of said actuating lever.

10. The apparatus of claim 1, further comprising:

adjustable stop means, operably associated with said frame and said actuating lever, for limiting a string tension varying pivoting motion of said actuating lever relative to said frame, said stop means including:

threaded stop pin extending through a threaded hole in said actuating lever toward said frame; and an elongated locking bar means, threadedly engaged with said stop pin, for locking said stop pin in position relative to said actuating lever so that the position of said stop pin can be varied by manually loosening said locking bar means, rotating said stop pin within said threaded hole and then manually retightening said locking bar means to relock said stop pin in its new position.

11. The apparatus of claim 1, wherein:

said frame includes a first frame portion and a second frame portion;

said adapter means is operably associated with said first frame portion for removably attaching said first frame portion to said protruding structure of said guitar; and said apparatus further comprises connecting means, between said first and second frame portions for permitting sliding motion of said second frame portion relative to said first frame portion in a direction generally parallel to a length of a guitar after string tension is released on said one guitar string, and for permitting pivotal motion of said second frame portion relative to said first frame portion after said first and second frame portions are slidably separated so that said actuating lever can be laid down adjacent said guitar body for storage of said guitar.

12. The apparatus of claim 11, wherein:

said connecting means further includes interlocking alignment means for locking said first and second frame portions together so that there can be no pivotal motion therebetween when said one guitar string is under normal operating tension.

13. The apparatus of claim 2, wherein said protruding structure of said guitar is a tail piece located rearward of a bridge of said guitar.

14. The apparatus of claim 1, said protruding structure having a string receiving passage therethrough for receiving said one guitar string, said apparatus further comprising:

a guide roller means, rotatably mounted on said frame and having a peripheral groove defined therein and located to be aligned with said passage, for guiding said one guitar string through said passage of said protruding structure.

15. The apparatus of claim 1, said protruding structure of said guitar body having a rearward surface and having a plurality of string receiving passages disposed therethrough intersecting said rearward surface, wherein said adapter means comprises:

a plate constructed to abut said rearward surface of said protruding structure, said plate having a plurality of string receiving holes defined therethrough and arranged to be aligned with said plurality of string receiving openings of said protruding structure, so that said guitar strings can be placed through said passages and holes and then tensioned to clamp said plate tightly against said rearward surface.

16. The apparatus of claim 15, said rearward surface of said protruding structure being a planar rearward surface, wherein said plate is a flat plate.

17. A stringed instrument, comprising:

a body;

a plurality of strings mounted on said body; and a string bender means, including a frame and an actuating lever pivotally attached to said frame, and having one of said strings attached to said actuating lever, for varying tension on said one string by pivoting said actuating lever relative to said frame, wherein at least a portion of said string bender means including said lever is held in place relative to said body by a tension force in said one string attached to said lever.

18. The instrument of claim 17, wherein said string bender means further comprises:

connecting means for slidably mounting said portion of said string bender means upon a remainder of said string bender means for sliding motion relative thereto in a direction generally parallel to said strings.

19. The instrument of claim 18, wherein:

said connecting means of said string bender further includes a pivot means for permitting pivotal motion of said portion of said string bender means relative to said remainder of said string bender means after sliding separation thereof so that said actuating lever can be laid down adjacent said body for storage of said stringed instrument.

20. The instrument of claim 18, wherein:

said connecting means further includes interlocking alignment means for locking said portion and said remainder of said string bender means against pivotal motion therebetween when said one string is under normal operating tension.

21. The instrument of claim 18, wherein:

said string bender means is entirely held in place relative to said body solely by tension forces in said plurality of strings.

22. An apparatus for varying a pitch of one or more strings of a guitar, said apparatus comprising:

a frame having a forward frame portion and a rearward frame portion;

attachment means for attaching said forward frame portion to said guitar;

an actuating lever pivotally attached to said rearward frame portion, said actuating lever including means for connecting a guitar string thereto so that tension on said string can be varied by pivoting said actuating lever relative to said frame; and breakdown means, interconnecting said forward and rearward frame portions for allowing said rearward frame portion to be moved relative to said forward frame portion between an operating position and a breakdown position, said operating position being such that said actuating lever extends generally away from said guitar and is operable to vary said tension on said string, and said breakdown position being such that said actuating lever is positioned closer to said guitar so that said guitar may be more easily received in a guitar case for storage.

23. The apparatus of claim 22, wherein said breakdown means comprises:

connecting means, between said forward and rearward frame portions for permitting said rearward frame portion to slide relative to said forward frame portion in a direction generally parallel to a length of said guitar; and interlocking alignment means for locking said rearward frame portion in its said operating position when said guitar string is under normal operating tension.

24. The apparatus of claim 23, wherein:

said connecting means includes a cylindrical pin attached to one of said forward and rearward frame portions, said pin being slidably received in a cylindrical bore disposed in the other of said forward and rearward frame portions.

25. The apparatus of claim 23, wherein:

said interlocking alignment means includes a protrusion defined on one of said forward and rearward frame portions, and a complementary recess defined in the other of said forward and rearward frame portions, said protrusion being closely received in said recess when said rearward frame portion is in its said operating position.

26. An apparatus for varying a pitch of one or more strings of a guitar, comprising:

a frame;

mounting means for attaching said frame to said guitar;

an actuating lever pivotally attached to said frame, said actuating lever including string engagement means for connecting a guitar string of said guitar thereto and for varying tension on said string by pivoting said actuating lever relative to said frame; and adjustable stop means operably associated with said frame and said actuating lever, for limiting a string tension varying pivoting motion of said actuating lever relative to said frame, said stop means including:

a threaded stop pin extending through a threaded hole in said actuating lever toward said frame; and an elongated locking bar means, threadedly engaged with said stop pin, for locking said stop pin in positive relative to said actuating lever so that the position of said stop pin can be varied by manually loosening said locking bar means, rotating said stop pin with said threaded hole and then manually retightening said locking bar means to relock said stop pin in its new position.

* * * * *

UNITED STATES PATENT AND TRADEMARK OFFICE

CERTIFICATE OF CORRECTION

PATENT NO. : 5,140,884

DATED : August 25, 1992

INVENTOR(S) : Richard M. Bowden

It is certified that error appears in the above-identified patent and that said Letters Patent is hereby corrected as shown below:

Column 1, line 22, delete "On" and insert --One-- therefor.

Column 3, line 3, delete "i" and insert --is-- therefor.

Column 5, line 43, delete "B4" and insert --84-- therefor.

Column 12, line 22, delete "positive" and insert --position-- therefor.

Signed and Sealed this

Thirty-first Day of August, 1993

Bruce Lehman

*Attest:*

BRUCE LEHMAN

*Attesting Officer*

*Commissioner of Patents and Trademarks*